United States Patent [19]

Weller

[11] Patent Number: 4,768,320

[45] Date of Patent: Sep. 6, 1988

[54] DOOR FRAME GUARD

[76] Inventor: Rick W. Weller, 315 E. Franklin St., Circleville, Ohio 43113

[21] Appl. No.: 917,698

[22] Filed: Oct. 10, 1986

[51] Int. Cl.[4] ..... E06B 1/04

[52] U.S. Cl. ..... 52/211; 52/732; 52/823; 52/DIG. 12

[58] Field of Search ..... 52/732, DIG. 12, 823, 52/716, 211, 254; 49/462

[56] References Cited

U.S. PATENT DOCUMENTS

| | | | |
|---|---|---|---|
| 2,837,787 | 6/1958 | Wright . | |
| 3,391,509 | 7/1968 | Fruman | 52/211 X |
| 3,559,356 | 2/1971 | Koral | 52/254 |
| 3,566,563 | 3/1971 | Ruff | 52/211 |
| 3,706,173 | 12/1972 | Taylor | 52/823 X |
| 4,242,848 | 1/1981 | Schoultz | 52/716 |
| 4,338,148 | 7/1982 | Adell | 52/823 X |
| 4,443,508 | 4/1984 | Mehl | 428/122 |
| 4,555,870 | 12/1985 | McKinnon et al. | 52/823 X |
| 4,570,383 | 2/1986 | Adell | 52/716 X |
| 4,581,807 | 4/1986 | Adell | 49/462 X |

*Primary Examiner*—Carl D. Friedman

*Attorney, Agent, or Firm*—Thomas S. Baker, Jr.

[57] ABSTRACT

A door frame guard for protecting a door jamb and door trim having a central section and a pair of conveying end sections extending from opposite sides of the central section. The guard includes a relatively stiff outer shell and a relatively soft inner lining which overlies and engages the door jamb and door trim.

8 Claims, 1 Drawing Sheet

DOOR FRAME GUARD

BACKGROUND OF THE INVENTION

During the construction phase of the interior of a building, door jambs and door trim may be installed on the walls defining door openings to provide a finished door frame before the remainder of the building interior has been completed. Doors for these openings typically are installed subsequent to the completion of the construction of the interior of the building. Consequently, for some period of time, construction personnel, construction materials and equipment must pass through the door openings defined by the finished door frames. Inevitably, some of the door jambs and/or door trim of the finished door frame are struck and damaged by the materials and equipment passing through the door openings.

Consequently, at the completion of the construction of the building interior, the damaged door jambs and door trim must be repaired. Such repair normally entails removing the damaged door jambs and trim from the walls and replacing them. Door jambs and trim must be cut, sanded, and finished by skilled carpenters. Thus, the repair of damaged door frames entails considerable time and expense.

The longitudinal edges of the door jambs and door trim are particularly vulnerable to damage when struck by materials or equipment. In order to protect these edges, some type of guard may be placed over the finished door frame until the construction of the building has been completed. Examples of guards or protective devices for door jambs or for wall corners may be seen in U.S. Pat. Nos. 2,837,787 to Wright; 3,559,356 to Koral; 4,242,848 to Schoultz; and 4,443,508 to Mehl. However, the protective devices disclosed in these patents do not lend themselves to temporary installation of a finished door frame during the construction phase of a building. The structures disclosed in Koral and Schoultz are designed to be permanently affixed to the wall or corner being protected. The protective device of Wright is designed for use with flat walls. Likewise, the edge protector disclosed by Mehl is a rigid device, having flexible gripping pads which are best adapted to engage flat surfaces such as glass.

Although it has been found preferable to construct a door frame guard from a relatively rigid material to ensure that it will withstand severe impacts, it has been found that the edges of door jambs and door trim may be damaged when a rigid guard is utilized because impacts applied to the rigid guard may be transmitted directly to these edges. Hence it is desirable to provide a guard for a door frame, which has sufficient stiffness to withstand severe impacts, yet has a capability to resist transmitting the force of these impacts to the edges of door jambs and trim.

Additionally, it is desireable to provide a guard for a door frame which is inexpensive, which may be installed over a door frame easily, which will grip the door frame without requiring external fastening devices which may be removed from a door frame easily, and which may be reused.

SUMMARY OF THE INVENTION

The instant invention is directed to a door frame guard for protecting a door jamb and door trim comprising a generally rectangular central section and a pair of converging end sections extending from opposite sides of the central section. The guard includes an outer shell having an outer surface and an inner surface and an inner shell attached to the inner surface for overlying and engaging the door jamb and the door trim. The inner shell is formed from a softer material or a material have greater resilience than the material forming the outer shell. The materials comprising the inner and outer shells are selected to enable the converging end sections to have a range of movement away from and towards each other such that the end sections are adapted to grippingly engage the door frame.

DESCRIPTION OF THE PREFERRED EMBODIMENT

Figure 1:
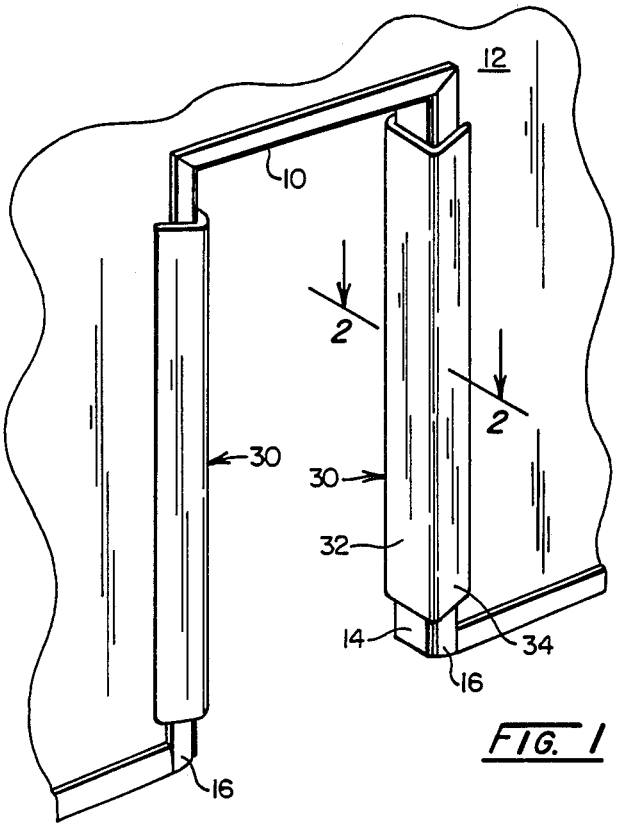
FIG. 1 is a perspective view showing a pair of door frame guards of the present invention installed over the vertical portions of a finished door frame defining a door opening.

Turning to FIG. 1, a doorway 10 is defined by an opening in a wall 12. A door jamb 14 which covers the lateral faces of the wall 12 and door trim 16, 17 provide a door frame for doorway 10. Door jamb 14 and door trim 16 may be seen in greater detail by referring to FIG. 2. In this figure it may be seen that wall 12 includes sheets of drywall 18 and 20 which are spaced apart by vertically extending studs 22. Door jamb 14 overlies the ends 23 and 25 of the drywall sheets 18 and 20 and one face 28 of stud 22. Trim pieces 16 and 17 are applied to the faces of drywall sheets 20 and 18 and overlie a portion of the ends 24 and 26, respectively of jamb 14.

The door frame guard 30 of the present invention includes a generally rectangular central section 32 and a pair of end sections 34 and 36 which extend from opposite sides of central section 32. Central section 32 has a width greater than the width between the outside surfaces 37 and 39 of door trim pieces 16 and 17 and end sections 34 and 36 converge towards each other and towards drywall sheets 20 and 18. It may be seen that guard 30 includes an outer shell 38 having an outer surface 40 and an inner surface 42 and a co-extensive inner lining or shell 44 adjacent to inner surface 42. Outer shell 38 is manufactured from a relatively hard but resilient material, such as rubber or plastic and inner shell 42 is manufactured from a relatively soft and resilient material, such as soft rubber or vinyl.

Figure 2:
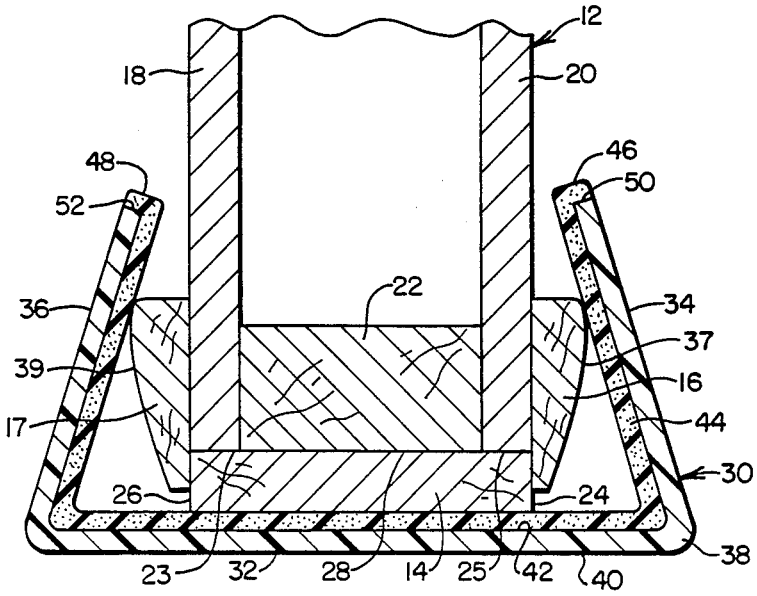
FIG. 2 is a sectional view along line 2—2 of FIG. 1.

Inner and outer shells 44 and 38 are manufactured from resilient materials such that end sections 34 and 36 may be moved apart from each other to enable these sections to be installed over the trim pieces 16 and 17, as shown in FIG. 2. When guard 30 is installed, end sections 34 and 36 grippingly engage door trim pieces 16 and 17. In the embodiment shown in FIG. 2, the ends 46 and 48 of sections 34 and 36, respectively, are spaced from drywall sheets 20 and 18. However, ends 46 and 48 may engage the drywall sheets 20 and 18 if the end sections 34 and 36 are of sufficient length. Preferably inner shell 44 overlies the ends 50 and 52 of outer shell 38 so that the softer and more resilient material is in contact with sheets 18 and 20. Although in the preferred embodiment the inner shell 44 is illustrated as being one continuous piece and overlying the entire surface 42 of outer shell 38, this is not necessary. Inner shell 44 may be discontinuous and only partially cover inner surface 42. It is necessary only to have the inner lining or shell 44 cover the areas of inner surface 42 that overlie door jamb 14 and door trim 16 and 17.

It has been found that by manufacturing door frame guard 30 with a relatively hard outer shell 38 and a relatively soft inner lining or shell 44 that engages the door frame, the outer shell 38 can resist relatively severe impacts and simultaneously the inner shell 44 can absorb or cushion a significant amount of the force of the impact that is transmitted to the door frame. Consequently, with the door guard 30 of the present invention, less force is transmitted to door jamb 14 and door trim pieces 16 and 17 and the damage to these members is significantly reduced. Additionally, the door guard 30 is installed easily over a door frame, is inexpensive to manufacture and is reuseable.

Outer shell 38 may be extruded from a plastic compound and inner shell 44, which overlies and is coextensive with the inner surface 42 of outer shell 48 may be extruded from a relatively soft vinyl material.

Since certain changes may be made in the above-described apparatus without departing from the scope of the invention herein involved, it is intended that all matter contained in the description or shown in the accompanying drawings shall be interpreted as illustrative and not in a limiting sense.

I claim:

1. A removable and reusable door frame guard for installation over and for providing temporary protection to a door jamb and door trim attached to a wall defining a door opening during construction of the interior of a building comprising:

a relatively rigid outer shell having an outer surface for deflecting objects impacting said guard and an inner surface;

a relatively soft shock absorbing inner shell bonded to said inner surface of said outer shell to prevent damage to said door jamb and trim;

said inner shell overlying a substantial portion of said outer shell;

said outer and inner shells defining a generally rectangular central section which overlies the door jamb and a pair of resilient generally straight inwardly converging end sections extending from opposite sides of said central section which overlie said door trim;

said end sections each defining an acute angle with respect to said central section; and wherein said end sections cooperate with said central section and with each other to provide a self supporting gripping action with said wall or with said door trim.

2. The door frame guard of claim 1 in which:

each of said end sections include an outer longitudinal edge; and wherein said inner lining overlies each of said outer longitudinal edges.

3. The door frame guard of claim 2 in which:

each of said inner surfaces on said end sections engages said door trim and said outer longitudinal edges are spaced from said wall.

4. The door frame guard of claim 1 in which:

said inner lining substantially covers the entire inner surface of said outer shell.

5. The door frame guard of claim 1 in which:

said inner lining contains at least one opening therein.

6. The door frame guard of claim 1 in which:

said inner shell and said outer shell are formed from first and second resilient materials.

7. The door frame guard of claim 6 in which:

said first and said second resilient materials are plastic.

8. The door frame guard of claim 6 in which:

one of said first or said second resilient materials is rubber.

* * * * *